United States Patent [19]

Ishinaga

[11] Patent Number: 4,914,938

[45] Date of Patent: Apr. 10, 1990

[54] FULLY ENCLOSED DIE FORGING APPARATUS

[75] Inventor: Nobuyuki Ishinaga, Saganihara, Japan

[73] Assignee: Aida Engineering, Ltd., Kanagawa, Japan

[21] Appl. No.: 214,305

[22] Filed: Jul. 1, 1988

[30] Foreign Application Priority Data

Jul. 6, 1987 [JP] Japan ..... 62-168319
Apr. 28, 1988 [JP] Japan ..... 63-105813

[51] Int. Cl.[4] ..... B21J 13/02
[52] U.S. Cl. ..... 72/354; 72/452
[58] Field of Search ..... 72/354, 407, 432, 452

[56] References Cited

U.S. PATENT DOCUMENTS 4,653,310 3/1987 Urata et al. ..... 72/354

*Primary Examiner*—Lowell A. Larson
*Attorney, Agent, or Firm*—Kalish & Gilster

[57] ABSTRACT

According to the present invention, there is provided a full enclosed die forging apparatus having an upside die and an underside die disposed opposedly in a vertical direction between a slide and a bolster. There is an upside cylinder mechanism contained in the slide which urges the upside die downward. There is an underside cylinder mechanism contained in the bolster which urges the underside die upward. An upside punch is inserted in the upside die and moves synchronously with the movement of the slide. An underside punch is inserted into the underside die and is supported by the bolster. A die moving mechanism having a support member is positioned between the underside die and the underside cylinder mechanism. A push pin is adapted to move synchronously with the slide. There is a cam mechanism that moves with the support member causing both punches to rush into the dies, respectively, by moving the upside die and underside die toward the underside punch at a speed slower that the moving speed of the slide.

6 Claims, 13 Drawing Sheets

FULLY ENCLOSED DIE FORGING APPARATUS

BACKGROUND OF THE INVENTION

1. Field of the Invention

The present invention relates to a full enclosed die forging apparatus and more particularly a full enclosed die forging apparatus provided with a die moving mechanism which has both punches operate to rush into dies, respectively, by moving a die maintained with contact following the movement of a slide toward a punch on a fixed side at a speed slower than the moving speed of the slide.

2. Description of the Prior Art

Full enclosed die forging in which raw material is forged in a cavity obtained by having a pair of dies contact with each other is being widely used recently for forging various products because yield of the raw material is high, and moreover, products having complex shapes may be manufactured with high accuracy.

Conventionally, full enclosed die forging of molded or forged articles 11 represented by a spider of a triport type equal velocity joint for automobiles and so forth having shapes as shown in FIG. 14 and FIG. 15 is performed in such a manner that a cylindrical slug 13 as shown in FIG. 16 is inserted in cavities 19 and 21 formed with an upper die 15 and a lower die 17 as shown in left part of FIG. 17, and upper and lower punches 23 and 25 are made close to each other as shown in the right part of FIG. 17.

Thereupon, when the shape of an aimed forged article 11 is of face symmetric with reference to a cross-section 27 having the maximum area as the forged article 11 described above, it is required to operate upper and lower punches 23 and 25 keeping face symmetry with reference to a cross-section 31 of the maximum area of a cavity 29 while maintaining such a state that above-mentioned upper die 14 and lower die 17 are made to contact with each other and enclosing force is applied.

Because of such reason, a full enclosed die forging apparatus as shown in FIG. 18 has been used conventionally. For such a full enclosed die forging apparatus, a hydraulic or mechanical double action press is illustrated, and the left half of the drawing shows the state before forging and the right half of the drawing shows the state after forging respectively.

In the drawing, reference numeral 11 denotes a forged article, 13 denotes a slag, 15 denotes an upper die, 17 denotes a lower die, 23 denotes an upper punch, 25 denotes a lower punch, 33 denotes a slide of a press, 34 denotes a bolster, 35 denotes a bed, 36 denotes an upper pressure pin and 37 denotes a lower pressure pin.

In this full enclosed die forging apparatus, first, the slug 13 is charged by hand or by a feeding device into a cavity 38 of the lower die 17. Next, when the slide 33 of the press descends, the upper and lower dies 15 and 17 come in contact with each other. In a hydraulic press, the slide 33 is urged downward by means of a hydraulic device, and in a mechanical press, the slide 33 stops at the bottom dead center, thereby to apply enclosing force to the upper and lower dies 15 and 17.

In succession, in a hydraulic press, a hydraulic unit which is of a different system from the unit for driving the slide 33 installed on the side of the slide 33 and on the side of the bed 35 is operated. In case of a mechanical press, a driving unit installed separately from the unit for driving the slide 33 is operated in the same manner as in the case of the hydraulic press. With this, the upper and lower pressure pins 36 and 37 are operated, the upper and lower punches 23 and 25 are moved toward above-mentioned cross-section 31, and the slug 13 is pushed out for working toward the cavity 29 formed by the upper and lower dies 15 and 17.

Then, after molding, the slide 33 is ascended and the upper and lower dies 15 and 17 are separated. During ascending or at the upper limit thereof, the upper and lower punches 23 and 25 are operated by the hydraulic unit, and the forged article 11 is discharged out of the die.

However, it is required to employ a double action press in order to apply such a full enclosed die forging apparatus to a hydraulic press. Accordingly, a special purpose machine is required for the forged article 11, which spoils universality. Also, in case of temperature change of pressure oil for operating the upper and lower punches 23 and 25, mixing of bubbles into the pressure oil and so forth are generated, the speed of the upper and lower punches 23 and 25 is changed, which makes it impossible to secure the product accuracy of the forged article 11. In order to avoid this, it has been required to add a correction mechanism which always performs flow control properly.

Besides, in case of application to a mechanical press, a special purpose machine in which a drive unit for driving the upper punch 36 is provided on the side of the slide 33 and a pressure drive unit is also provided on the side of the bed 35 is required. Moreover, the upper and lower dies 15 and 17 being fitted together at the bottom dead point, enclosing force becomes unstable. Therefore, more enforcing force than required is applied to the press and the upper and lower dies 15 and 17, which makes the life of the metal mold shorter.

The subject applicant has previously applied for patent on a full enclosed die forging apparatus which is laid open under Provisional Publication No. 133927/84 as a full enclosed die forging apparatus which is capable of solving such problems.

FIG. 19 shows a full enclosed die forging apparatus disclosed in said Publication. The left half of the Figure shows a state when full enclosing is commenced, and the right half thereof shows the state when forging is completed at the bottom dead point.

In the Figure, an upside die set plate 61 is fixed to a slide 60 of the press, and an insert plate 62 is inserted into this upside die set plate 61 with positioning by a knock pin 63.

In slide 60, a cushion pin 65 is urged downward by installing a cushion rod 64 which is urged downward by pressure liquid so as to ascend and descend freely. Similarly, a knockout rod 66 is provided in slide 60 so as to ascend and descend freely.

An upside die holder 67 is fixed to the upside die set plate 61, a cam holder 68 is fixed to die holder 67, and furthermore, a first cam 69 is fixed to the cam holder 68. Besides, first cam 69 drives the lower die through a second, a third and a fourth cams which will be described later.

An upper die 70 is fitted to the inside of the upside die holder 67 so as to ascend and descend freely. A punch block 71 and an upper punch 72 are fitted to the inside of this upper die 70 so as to ascend and descend freely.

On the other hand, an underside die set plate 74 is fixed to a bolster 73, and an insert plate 75 is inserted into this die set plate 74. Further, in bolster 73, a knockout rod 76 is provided so as to push up a knockout pin 77 at a constant timing by receiving a pushing-up force by pressure liquid or a mechanical device. In a similar manner, in bolster 73, a cushion rod 78 is provided so as to urge a cushion pin 79 in the insert plate 75 upward.

To the underside die set plate 74, an underside die holder 80 is positioned and fixed with a knockout pin 81, and a plate 83 is positioned and inserted into this die holder 80 through a knockout pin 82. Further, in underside die holder 80, pats 84 and 85 are built in, and a spring 86 is installed under compressed condition between these pats 84 and 85.

Besides, this spring 86 urges a lower die which is described later upward through a pressure pin 87 penetrating the plate 83 and said pat 84. Inside spring 86, a cushion ring 88 is disposed so as to ascend and descend freely, and the urging force of the cushion pin 79 is arranged so as to be conveyed to a lower die 90 from a pressure pin 89 through this cushion ring 88.

It is also arranged that, at the center of the upper surface of said insert plate 75, a die anvil 92 is provided that penetrates punch block 91 so as to ascend and descend freely, and a lower punch 93 is pushed up with a predetermined timing receiving pushing-up action of a knockout pin 77 by attaching a lower punch 93 on the upper part of the punch block 93.

On the other hand, a guide 95 for guiding a second cam 94, etc. is fixed to said underside die holder 80. This second cam 94 is held by fitting slidably at a bore portion of the guide 95 having a circular form, and the bore portion of this cam 94 is fitted to the lower die 90. A step portion 94*a* of the cam 94 is engaged with the step portion of the lower die 90, and then cam 94 is held by fitting slidably in a vertical direction only in a guide groove 96 along the center of the die 90.

Further, third and fourth cams 97 and 98 which are held slidably in a circumferential direction only by the lower die 90 and the guide 95 are provided between first cam 69 and second cam 94. Thus, when first cam 69 descends, second cam 94 moves downward through third and fourth cams 97 and 98.

FIG. 20 thru FIG. 2 are drawings showing the locations and operating condition of these cams. As seen from these drawings, two pieces of the first cams 69 are provided at diagonal locations of the cam holder 68 and formed in a cleat shape contracting downward, and the inclined faces of these first cams 69 are made to face between end inclined faces of adjacent third and fourth cams 97 and 98 from the upper part.

Also, the second cam 94 is provided at a location the phase of which is shifted from the first cam 69 by 90° and formed in a cleat shape expanding downward, and by having the inclined surface face between point inclined faces of third and fourth cams 97 and 98 from the lower part, third and fourth cams 97 and 98 are moved in a circumferential direction thereby to push the second cam downward when the first cam 69 descends. Besides the base ends of the third and the fourth cams 97 and 98 are formed into inclined faces going upward and the point ends are formed into inclined faces going downward.

In a full enclosed die forging apparatus thus constructed, the slug inserted into the cavity of the lower die 90 is formed under a condition that upper and lower dies 70 and 90 are fully enclosed, and is taken out by the operation of the knockout pin 77, etc.

Thereupon, in this full enclosed die forging apparatus, at the same time as upper and lower dies come in contact with each other, third and fourth cams 97 and 98 and the first cam 69 contact with each other as shown in FIG. 21. Therefore, when the slide 60 descends and the first cam 69 also descends, adjacent third cam 97 and fourth cam 98 are moved in a horizontal direction, and the second cam 94 which is put between both cams 97 and 98 is pushed downward. As the result, the die 90 which is engaged with the second cam 94 descends.

The descending speed of this die 90 is made slower than the descending speed of the punch 72 by setting the angle of each cam face at a predetermined angle, and upper and lower punches 72 and 93 move respectively to upper and lower dies 70 and 90.

In short, despite that upper and lower dies 70 and 90 descend at a lower speed than the descending speed of the upper punch 72, the lower punch 93 does not move. Accordingly, when the slide 60 is made to descend, upper and lower punches 72 and 93 rush into upper and lower dies 70 and 90, respectively, and move closely, thereby to perform expected forging.

In such a conventional full enclosed die forging apparatus, however, the first cams 69 are attached to the die forming member of the upper die and ascends and descends together with the slide, and respective cams 69, 94, 97 and 98 are disposed on the outer circumference of the lower die 90 so that the lower die 90 is made to descend directly with these cams as shown in FIG. 20. Therefore, the degree of freedom for the arrangement of the cam mechanism is limited to an extreme. For example, it is required to dispose respective cams 69, 94, 97 and 98 in a circular form. As the result, the form of cams becomes very complicated, which takes time for processing and also makes it impossible to achieve high accuracy.

Also, resulting from the above, control of the descending speed of dies 70 and 90 is lacking in correctness. Thus, the forged articles are of low precision and unstable. Furthermore, the lower end portion of the first cam 96 is positioned below the upper surface of the upper face of the lower die 90. Therefore, when an automatic forging (a forging in which charging of raw material and taking-out of molded articles are performed with an automated apparatus) is executed, the first cam 96 and the automated apparatus often interfere with each other in the course of ascending or descending of the slide, which limits the applied automated apparatus.

Moreover, when forged articles having different outer diameter dimensions of dies 70 and 90 are to be produced with this apparatus, the cam mechanism must be manufactured each time and correspondence to other forged articles is poor.

SUMMARY OF THE INVENTION

It is an object of the present invention which solves above-described problems to provide a full enclosed die forging apparatus which is capable of simplifying a cam mechanism by a larger margin than before by increasing the degree of freedom for arrangement of the cam mechanism.

It is a further object of the present invention to provide a full enclosed die forging apparatus having a simplified cam mechanism with linear cams.

It is a still further object of the present invention to provide a full enclosed die forging apparatus with an increased degree of freedom for the arrangement of the cam mechanism.

It is a further object of the present invention to provide a full enclosed die forging apparatus having accurate control for the decreasing die speed so that accurate forged articles are obtained.

It is a further object of the present invention to provide a full enclosed die forging apparatus where accessibility to the dies is improved so that automatic production is increased.

A still further object of the present invention is to provide a full enclosed die forging apparatus having a cam mechanism capable of accommodating dies of various sizes.

DESCRIPTION OF THE PREFERRED EMBODIMENT OF THE INVENTION

According to the present invention, there is provided a full enclosed die forging apparatus provided with an upside die and an underside die disposed opposedly in a vertical direction between a slide and a bolster, an upside cylinder mechanism which is disposed on an upside die set plate disposed on said slide or at a lower end of this slide and urges said upside die downward, an underside cylinder mechanism which is disposed on an underside die set plate disposed on said bolster or at an upper end of this bolster and urges said underside die upward, an upside punch which is inserted in said upside die and moves synchronously with the movement of said slide, an underside punch which is inserted into said underside die and supported by said bolster, and a cam mechanism having both punches operated to rush i.e., accelerate into dies respectively, by moving said upside die and underside die toward the underside punch at a speed slower than the moving speed of said slide, wherein said die moving mechanism is composed of: a support member which is mounted between said underside die and underside cylinder mechanism for supporting said underside die directly or indirectly and urged upward directly or indirectly by means of said underside cylinder mechanism; a push pin moved downward synchronously with the movement of said slide; and a cam mechanism which moves said support member downward by the movement of this push pin at a speed slower than the moving speed of the slide.

In a full enclosed die forging apparatus according to the present invention, when the slide moves downward, the push pin is moved downward synchronously with the movement of the slide, the movement of the push pin is transferred to the cam mechanism, the support member is moved downward at a speed lower than the moving speed of the slide, the upside die and the underside die are moved toward the underside die are moved toward the underside punches, and both punches are operated to rush into respective dies.

The details of the present invention will be described hereinafter referring to embodiments shown in accompanying drawings.

Figure 1:
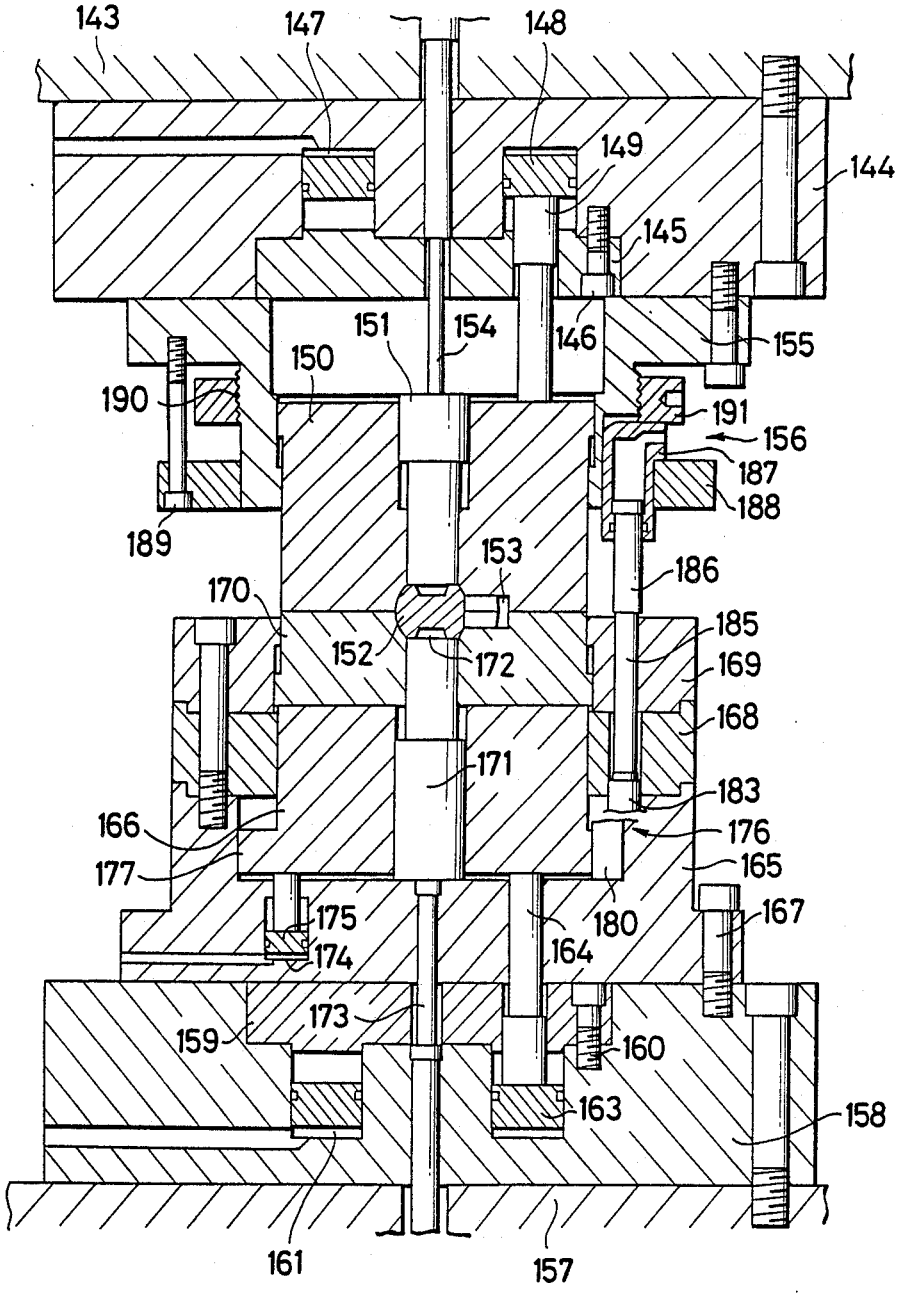
FIG. 1 shows a longitudinal cross-sectional view of a full enclosed die forging apparatus according to the present invention.

FIG. 1 shows an embodiment of a full enclosed die forging apparatus according to the present invention. In this full enclosed die forging apparatus, an upside die set plate 144 is fixed to a slide 143 of a press. An upside insert plate 145 is fixed with a bolt 146 to upside die set plate 144.

An upside cylinder 147 is formed on the upside die set plate 144, and an upside piston 148 is inserted into upside cylinder 147.

An upside actuating pin 149 is disposed on the underside of upside piston 148, and the lower end of upside actuating pin 149 abuts against an upper face of an upside die 150.

An upside punch 151 is inserted at the central portion of upside die 150, and a cavity 153 corresponding to the shape of an article 152 to be forged is formed at the lower part of upside die 150.

Penetrating through central portions of upside die set plate 144 and the upside insert plate 145, is disposed a knockout pin 154 so as to ascend and descend freely.

An upside die holder 155 is fixed to upside die set plate 144, and a cam mechanism operating portion 156 for operating a cam mechanism which will be described later is disposed on an outer circumference of upside die holder 155.

On the other hand, an underside die set plate 158 is fixed to the bolster 157 of the press. An underside insert plate 159 is fixed with a bolt 160 to underside die set plate 158. An underside cylinder 161 is formed in underside die set plate 158, and an underside piston 163 is inserted into underside cylinder 161.

An underside actuating pin 164 is disposed on the upper face of underside piston 163, and the upper end of underside actuating pin 164 abuts against a lower face of an underside pad 166 contained in an underside die holder 165 penetrating through the underside die holder 165. The underside die holder 165 is fixed to the underside die set plate 158 with a bolt 167, and underside holder 168 and underside guide 169 are disposed in succession on the upper part of underside die holder 165. An underside die 170 is inserted into underside guide 169. An underside punch 171 is inserted into the central portions of underside die 170 and underside pad 166, and a cavity 172 corresponding to the shape of the article 152 to be forged is formed in the upper part of underside die 170.

Penetrating through the central portions of underside die set plate 158, underside insert plate 159 and underside die holder 165, is disposed a knockout pin 173 so as to ascend and descend freely.

An auxiliary cylinder 174 is disposed in the underside holder 165, and an auxiliary piston 175 the upper end of which is abutted with the underside pad 166 through a pin is contained in auxiliary cylinder 174.

Further, in this embodiment, a cam mechanism 176 is disposed in the underside pad 166. This cam mechanism 176 is operated in such a manner that upperside die 150 and underside die 170 that are maintained with contact are moved toward an underside punch 171 on the fixed side pursuant to the movement of slide 143 at a speed lower than the moving speed of slide 143 thereby to have upper and lower punches 151 and 171 rush into upper and lower dies 150 and 170 respectively.

Figure 2:
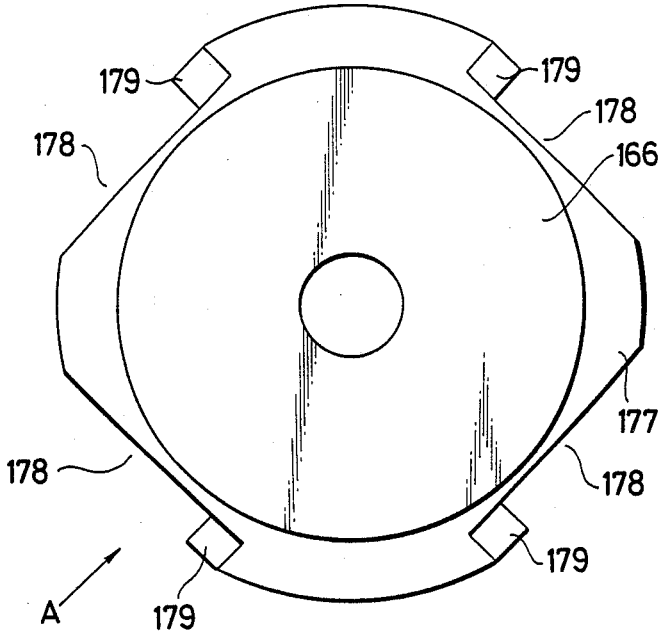
FIG. 2 is a top view of the underside pad shown in FIG. 1.
Figure 3:
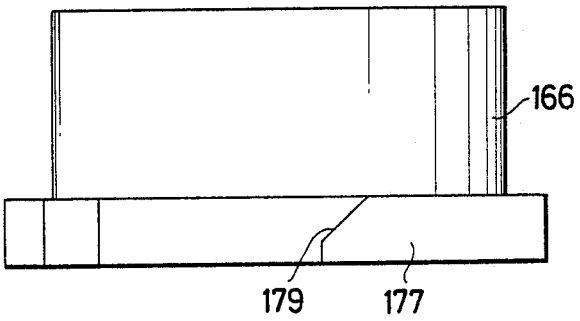
FIG. 3 is a view showing the underside pad shown in FIG. 2 in the direction of an arrow A.

That is, a large diameter portion 177 is formed at the lower part of underside pad 166 as shown in FIG. 2 and FIG. 3. At this large diameter portion 177, cutout portions 178 are formed at four locations at angles of 90°, and cam faces 179 are formed on these cutout portions 178 respectively. Cam faces 181 of horizontal cams 180 in rectangular parallelopiped shape are made to abut against these cam faces 179 as shown in FIG. 4 and FIG. 5.

Also, cam faces 184 of vertical cams 183 in plate form are made to abut against cam faces 182 formed at another ends of horizontal cams 180. The lower ends of the push pins 185 of the cam mechanism operating portion 156 shown in FIG. 1 are made to abut against the upper faces of vertical cams 183.

Figure 4:
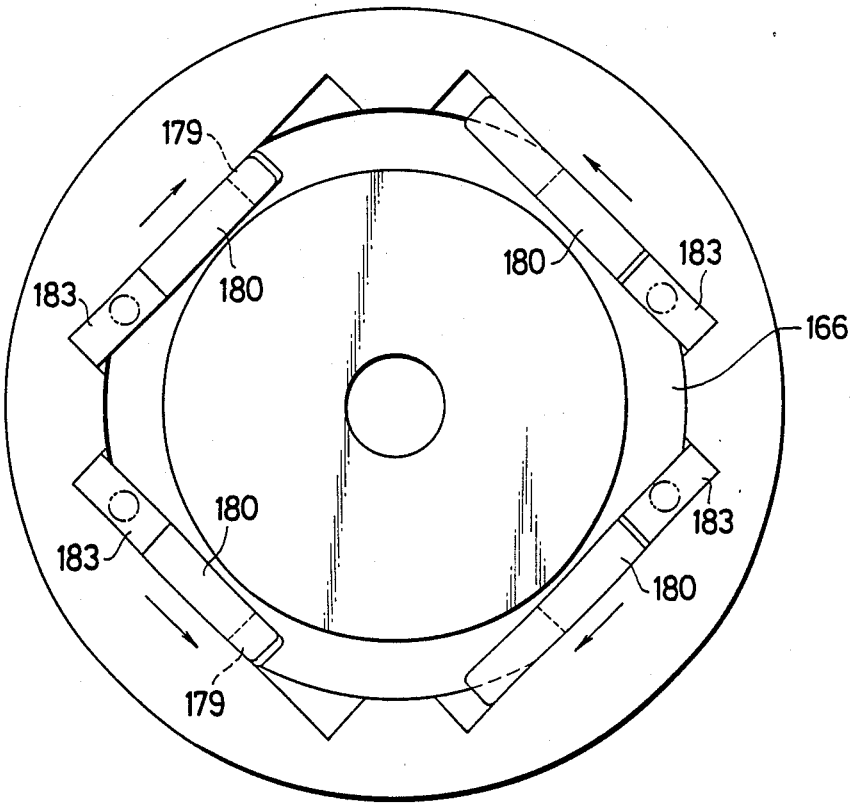
FIG. 4 is a top view showing a state in which a horizontal cam and a vertical cam are disposed on the underside pad.
Figure 5:
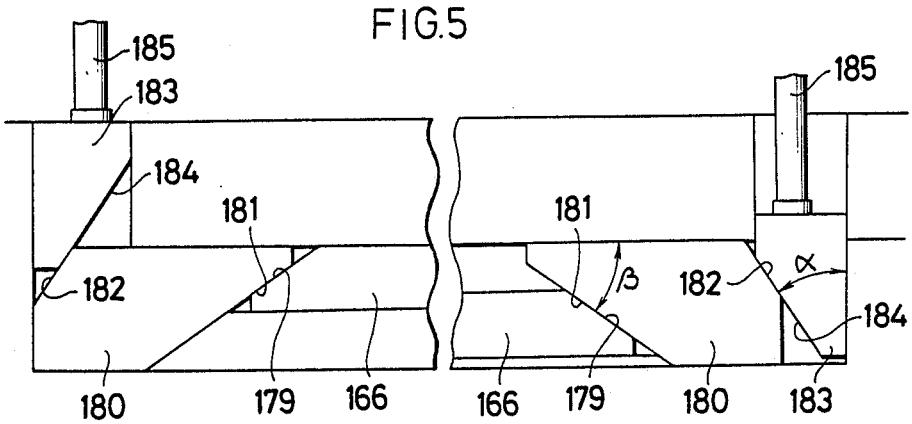
FIG. 5 is an explanatory view for explaining the operation of the cam mechanism shown in FIG. 4.

Besides, in FIG. 4 and FIG. 5, the left side of the Figure shows the state when vertical cam 183 is located at the upper limit position, and the right side thereof shows the state when vertical cam 183 is pushed by the push pin 185 and located at the lower limit position. The cam mechanism operating portion 156 includes a pin 186 which abuts against the upper face of push pin 185 as shown in FIG. 1, and the upper part of this pin 186 is inserted into the cylinder 187.

It is arranged that an oil at a certain pressure is supplied into cylinder 187 so that pin 186 may move upward when a great force is applied to it. The cylinder 187 is supported by a ring ferrule 188, and this ferrule 188 is fixed to the upside die holder 155 with a bolt 189.

Figure 6:
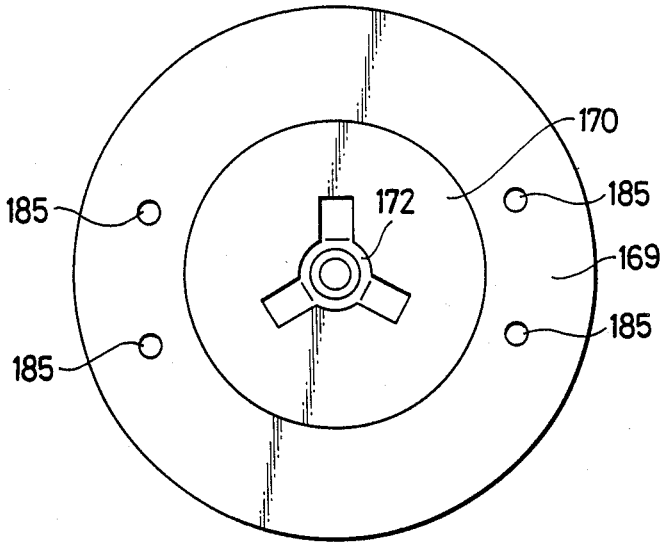
FIG. 6 is a top view showing the underside guide on which a push pin is disposed.
Figure 7:
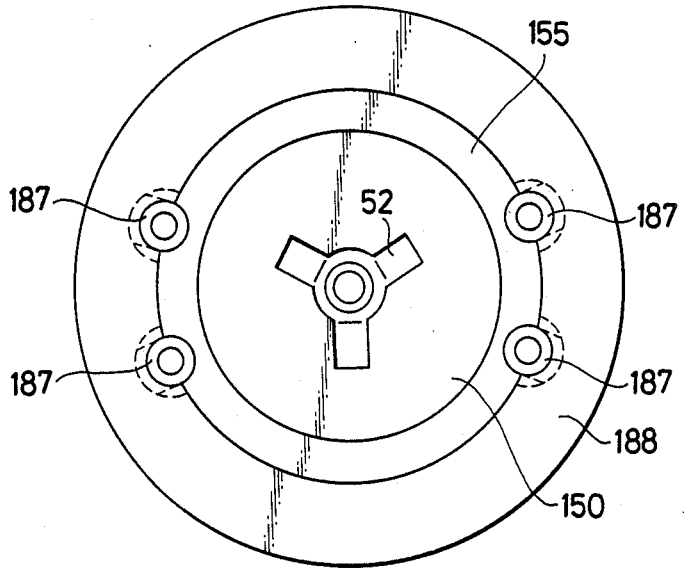
FIG. 7 is a top view showing a keep ring on which a cylinder is disposed.

Further a screw portion 190 is formed on the outer circumference of upside die holder 155, and a nut 191 for determining the upper end position of the cylinder 187 is screw-engaged with screw portion 190. With this, it is possible to adjust the lower end position of pin 186 so as to adjust the dimension $H_1$ and $H_2$ of the molded article. Besides, push pins 185 and cylinders 187 are disposed at four positions in a rectangular shape corresponding to the positions of vertical cams 183 as shown in FIG. 6 and FIG. 7.

Figure 8:
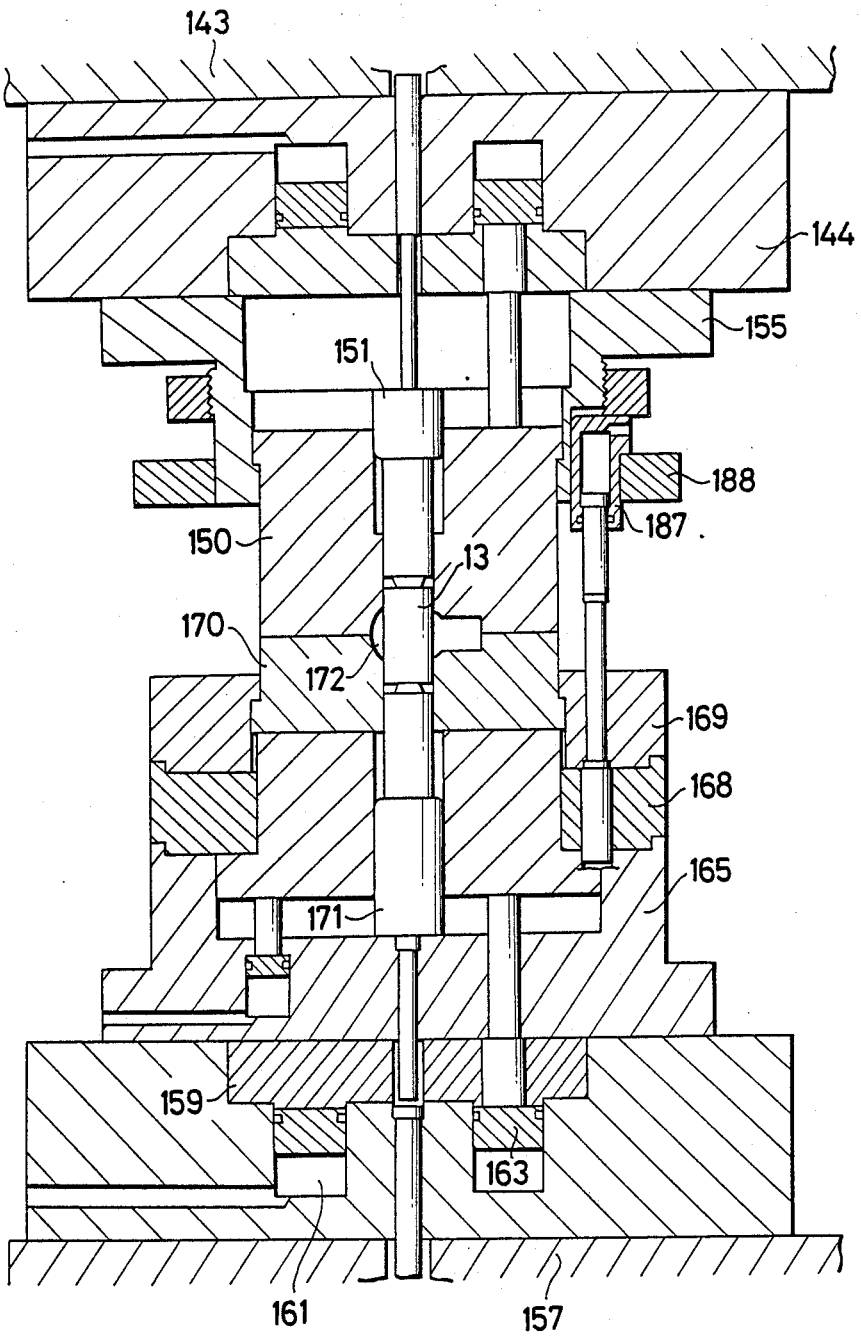
FIG. 8 is a longitudinal cross-sectional view showing a state in which a slug is inserted into the full enclosed die forging apparatus shown in FIG. 1.

As shown in FIG. 8, in the full enclosed die forging apparatus thus constructed, the slug 13 inserted into the cavity 172 of the underside die 170 is formed under fully enclosed state produced by the upside die 150 and the underside die 170 abutting against each other, and taken out by the action of the knockout pin, etc.

And, in the full enclosed die forging apparatus thus constructed, the lower face of the pin 186 and the upper face of the push pin 185 abut against each other when the upside die 150 and the underside die 170 come into contact with each other.

Thereafter, when slide 143 descends further and push pin 185 also descends, vertical cam 183 descends as shown in FIG. 4 and in the right side of FIG. 5. With this, horizontal cam 180 is pressed toward the cam face 179 of pad 166, the pad 166 moves downward, and at the same time, underside die 170 also moves downward.

Here, when it is assumed that cam angles of vertical cam 183 and horizontal cam 180 are $\alpha$ and $\beta$, respectively, the descending speed ratio of the pat 166 to the vertical cam 183 is given as follows:

$$\tan \alpha \times \tan \beta$$

Accordingly, after vertical cam 183 comes in contact with horizontal cam 180, the underside die 170 descends at a speed lower than that of the upside punch 151 as the upside punch 151 descends, and the upside punch 151 and the underside punch 171 move relatively to the upside die 150 and the underside die 170.

That is, despite that the upside die 150 and the underside die 170 descend at a speed lower than the descending speed of the upside punch 151, the underside punch 171 does not move. Therefore, when the slide 143 is made to descend, the upside punch 151 and the underside punch 171 rush into the upside die 150 and the undeside die 170, respectively, so as to move closely, thereby to perform expected molding.

When, for example, after upside die 150 and underside die 170 have contacted with each other, these are made to descend at a half of the descending speed of slide 143, viz when a molded article is of face symmetric related to the cross section of the maximum area, both angles of vertical cam 183 and horizontal cam 180, $\alpha$, and $\beta$, may be selected at 35 degrees 15 minutes 52 seconds theoretically.

Here, when it is assumed that the generating force of the upside cylinder 147 is at $P_U$, the generating force of the underside cylinder 161 is at $P_L$ the generating force of the auxiliary cylinder 174 is at $P_S$, and the force of the horizontal cam 180 to push down the underside pat 166 is at $P_C$, the force $F_U$ applied to the upside die is:

$$F_U = P_U$$

and the force $F_L$ applied to the underside die is:

$$F_L = P_L + P_S - P_C$$

When the molded article has a symmetric form with references to the cross-section of the maximum area $F_U = F_L$ is obtained. Namely, $P_C = (P_L - P_U) + P_S$ is obtained.

Here, $P_C > 0$ is required in order that respective cam faces are maintained by contact with each other. Such a condition is satisfied by $P_L > P_U$ even if there were no auxiliary cylinder ($P_S=0$). However, for the purpose of stabilizing the cam operation, viz., in order to stabilize the relative speed of the upside punch 151 and the underside punch 171 against the dies 150 and 170 during molding and to obtain a forged article of high accuracy, it is desired that the urging force of each cam face, viz., $P_C$ is constant.

However, $P_L$ and $P_U$ fluctuate because of viscosity variation of the pressure liquid, mixing of bubbles into the pressure liquid and so forth, thus, $$P_C=P_L-P_U \text{ (when } P_S=0)$$

is harldy constant.

In order to stabilize the urging force of the cam face, it is only required to make the cylinder diameters of the upside cylinder 147 and the underside cylinder 161 equal, and to supply pressure liquid from a common pressure liquid feeding device.

With such arrangement, even if viscosity variation of pressure liquid and mixing of bubbles into pressure liquid are generated, $P_L=P_U$, and in turn $P_C=P_S$, is always obtained. If a pressure liquid at an atmospheric pressure is supplied to the auxiliary cylinder, $P_S$, viz., $P_C$ becomes constant and the urging force applied to the cam face becomes stabilized, thus a molded article of high accuracy is obtainable.

Further, in the full enclosed die forging apparatus thus constructed, the die moving mechanism which moves upside die 150 and underside die 170 under fully enclosed state is composed of a support member consisting of the underside pad 166 which is installed between the underside die 170 and the underside cylinder 161 mechanism for supporting the underside die 170 directly and urged upward directly by means of the underside cylinder 161 mechanism, the push pin 185 moved downward synchronously with the movement of the slide 143, and the cam mechanism 176 which moves the underside pad 166 downward at a speed slower than the moving speed of the slide 143 by the movement of this push pin 185. Accordingly, it is no longer required to dispose respective cams on the outer circumference of the underside die and to descend the underside die directly with these cams as in a conventional case. With this, the degree of freedom for the arrangement of the cam mechanism is increased, and it becomes possible to construct the cam mechanism 176 with linear cams as shown in FIG. 2 thru FIG. 5, thus the cam mechanism may be simplified by a large margin as compared with a conventional case.

Figure 9:
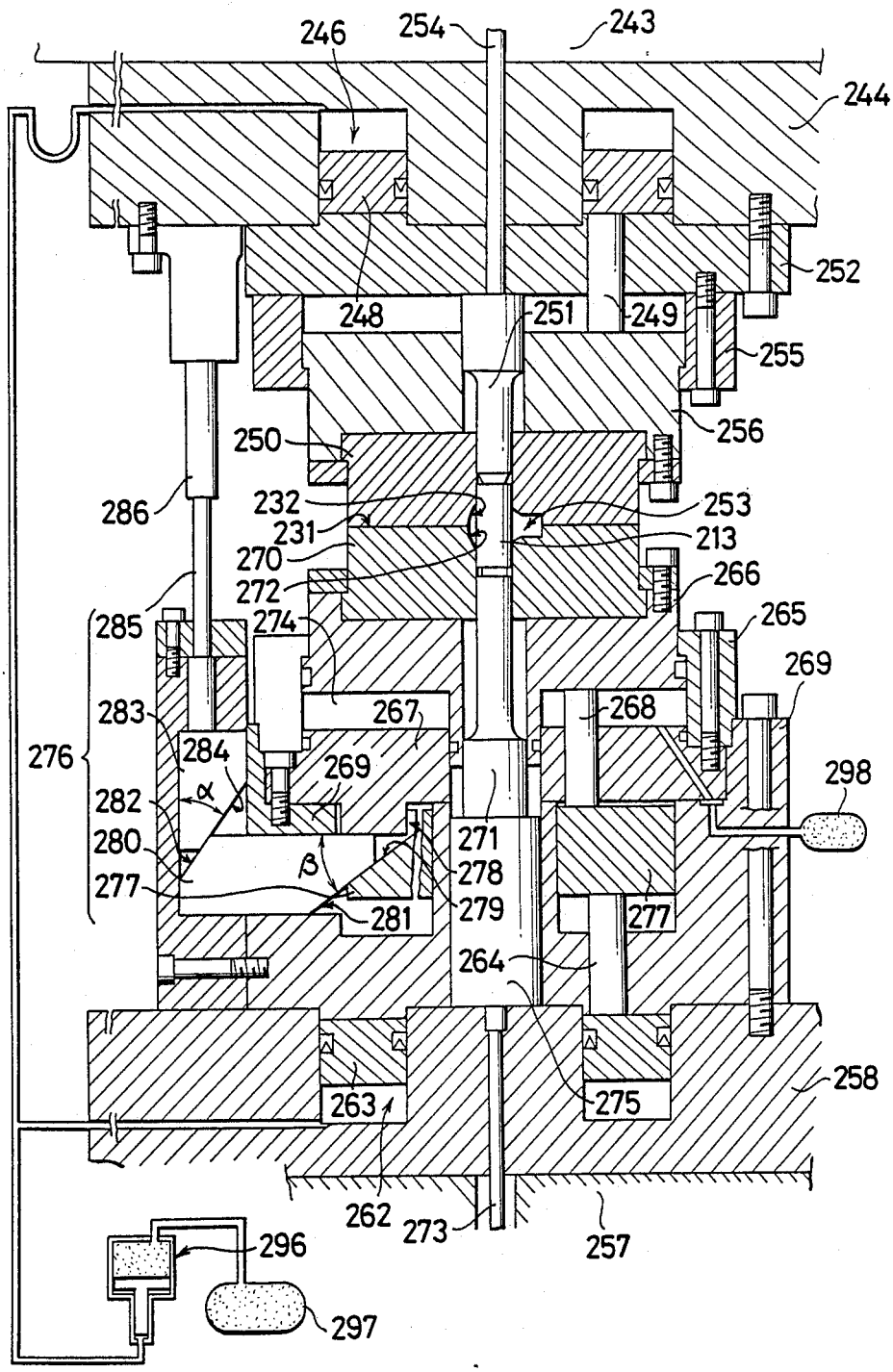
FIG. 9 is a longitudinal cross-sectional view showing a state when the vertical cam is positioned at the upper limit position in another embodiment of a full enclosed die forging apparatus according to the present invention.
Figure 10:
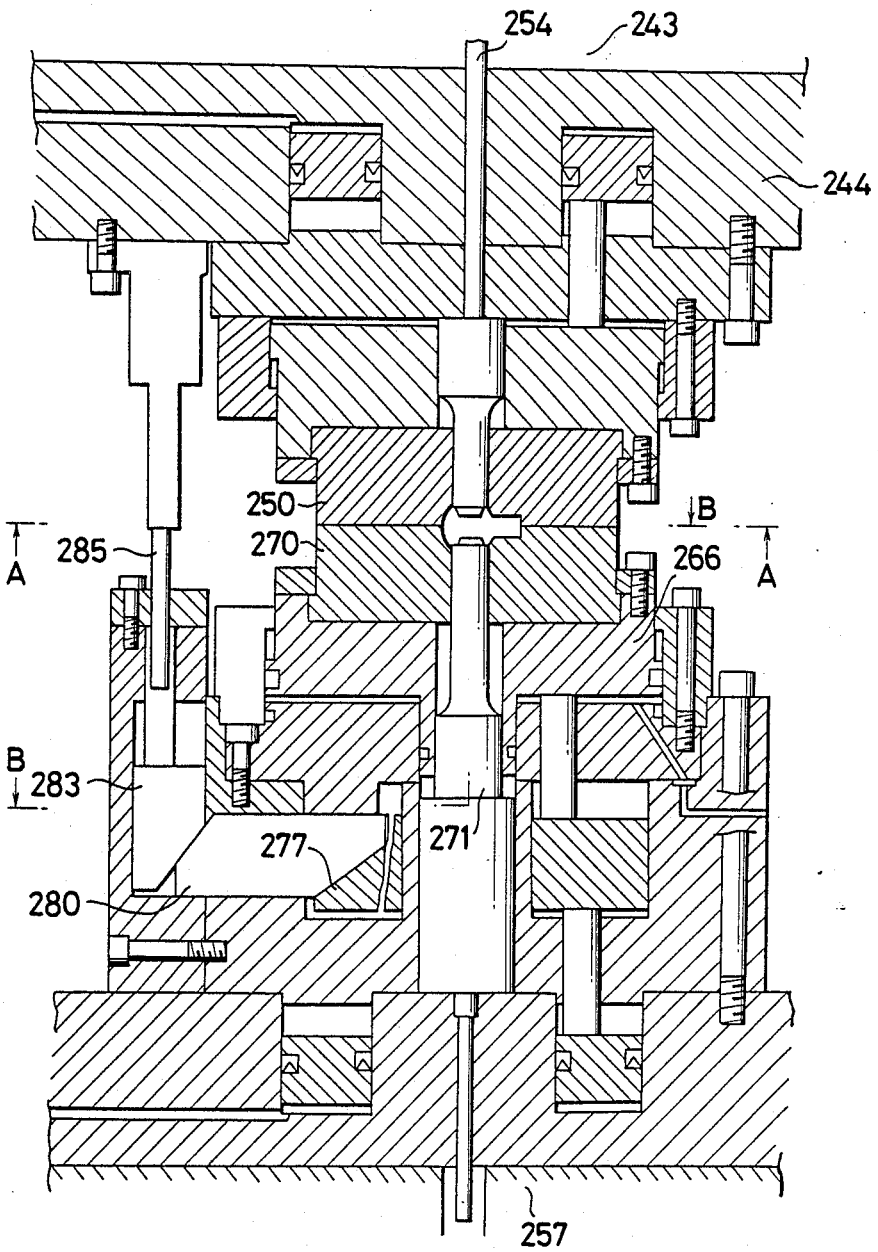
FIG. 10 is a longitudinal cross-sectional view showing a state when the vertical cam is pressed by the push pin and positioned at the lower limit position.
Figure 11:
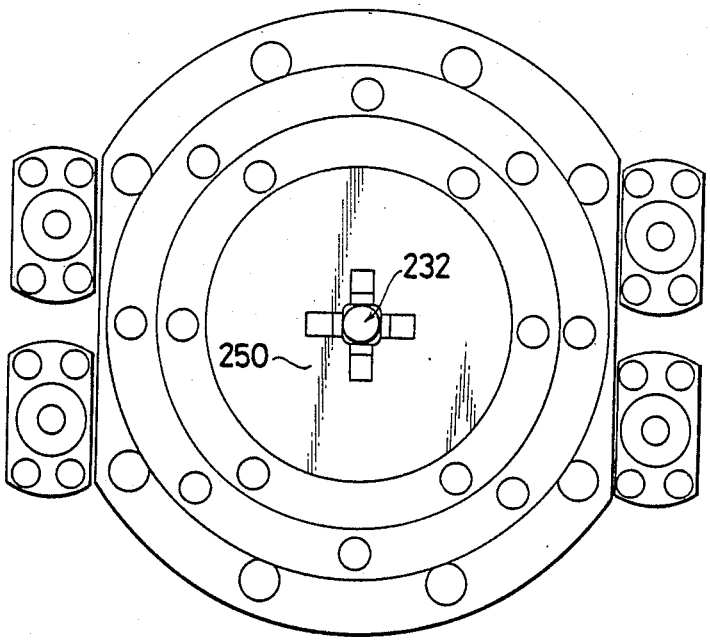
FIG. 11 is a horizontal cross-sectional view taken along a line A—A shown in FIG. 10.
Figure 12:
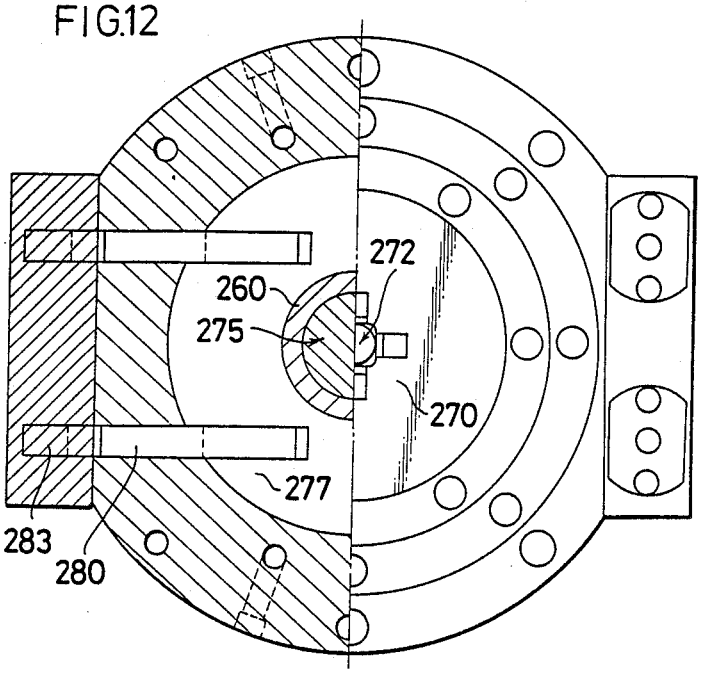
FIG. 12 is a horizontal cross-sectional view taken along a line B—B shown in FIG. 10.

FIG. 9 thru FIG. 12 show another embodiment of a full enclosed die forging apparatus according to the present invention. FIG. 9 shows the state when the vertical cam is at the upper limit position, FIG. 10 shows the state when the cam is pressed by the push pin and positioned at the lower limit position, FIG. 11 shows a cross-sectional view taken along the line A—A shown in FIG. 10 and FIG. 12 shows a cross-sectional view taken along the line B—B shown in FIG. 10, respectively. Besides, the forged article is a cross spider.

In this full enclosed die forging apparatus, an upside die set plate 244 is fixed to a slide 243 of the press. An upside cylinder chamber 246 is formed in upside die set plate 244, and an upside piston 248 is inserted into upside cylinder chamber 246 and closed with an upside keep plate 252.

A hydraulic oil is supplied to the upside cylinder chamber 246, which urges the upside piston 248 downward. An upside actuating pin 249 is disposed on the lower face of upside piston 248 with the upside keep plate 252 as a guide, and the lower end of upside actuating pin 249 abuts against an upper face of an upside die plate 256 which holds an upside die 250. Penetrating through the central portions of upside die set plate 244 and upside keep plate 252, is disposed a knockout pin 254 so as to ascend and descend freely.

An upside die holder 255 is fixed to upside die set plate 244 through upside keep plate 252, and a push pin 286 for operating a cam mechanism which will be described later is disposed surrounding upside die holder 255 under upside die set plate 244.

On the other hand, an underside die set plate 258 is fixed to a bolster 257 of the press. An underside cylinder chamber 262 is formed in underside die set plate 258, and an underside piston 263 is inserted into underside cylinder chamber 262 and closed with an underside guide 269.

A hydraulic oil is supplied into underside cylinder chamber 262, which urges underside piston 263 upward. Both inner and outer diameters of these underside cylinder chamber 262 and upside cylinder chamber 246 are connected with one piece of connecting piping and further connected a hydraulic oil supply unit. The hydraulic oil supply unit consists of an air hydraulic booster 296 and a surge tank 297, and the pressure of the compressed air is amplified and converted into the pressure of the hydraulic oil by means of the air hydraulic booster and supplied to lower and upper cylinder chambers 246 and 262.

The pressure of the hydraulic oil changes pursuant to the pressure of the compressed air of surge tank 297, which changes according to the stroke quantity of the piston of air hydraulic booster 296.

An underside actuating pin 264 is disposed on the upper face of underside piston 263 with underside guide 269 as a guide, the upper end of underside actuating pin 264 abuts against the lower face of an underside pad 277 contained in underside guide 269.

A second underside pin 268 which is guided by an intermediate plate 267 is disposed on the upper face of underside pad 277, and the upper face of this second underside pin 268 abuts against an underside die plate 266 which holds an underside die 270 contained in underside die holder 265. The underside die holder 265 is fixed with the intermediate plate 267, and underside guide 269 is disposed at the lower part of intermediate plate 267 and fixed to the underside die set plate 258.

An underside punch 271 is inserted into the central portions of the underside die 270 and the underside die plate 266, and the lower face thereof abuts against a punch plate 275.

A cavity 272 corresponding to a half of an article to be molded is formed in the upper part of the underside die 270. Penetrating through the central part of the underside die set plate 258, is disposed a knockout pin 273 so as to ascend and descend freely.

A lower sub-cylinder chamber 274 is formed in the underside die holder 265. This lower sub-cylinder chamber is communicated with the surge tank 298 and filled with compressed air. Accordingly, underside die plate 266 is urged upward, thus underside die 270 is also urged upward. Here, in this embodiment, a cam mechanism 276 which moves the underside pad 277 is disposed on this underside pad 277.

This cam mechanism 276 moves upside die 250 and underside die 270 which are maintained with contact toward the underside punch 271 on the fixed side pursuant to the movement of slide 243 at a speed lower than the moving speed of slide 243, and operate to have upper and lower punches 251 and 271 rush into upper and lower dies 250 and 270, respectively.

Figure 13:
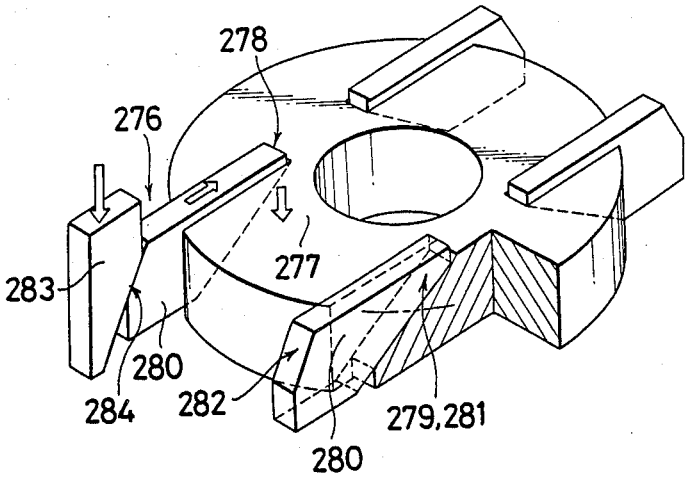
FIG. 13 is a perspective view showing a state in which a horizontal cam and a vertical cam are disposed on the underside pad.
Figure 14:
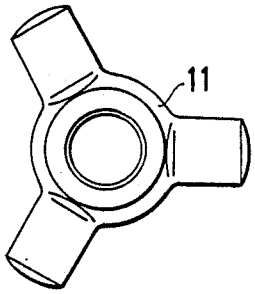
FIG. 14 is a top view showing an example of a product manufactured by a full enclosed die forging.
Figure 15:
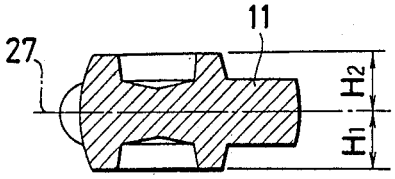
FIG. 15 is a longitudinal cross-sectional view of FIG. 14.
Figure 16:
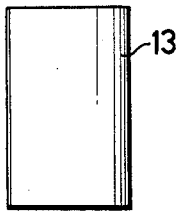
FIG. 16 is a side view showing a slug.
Figure 17:
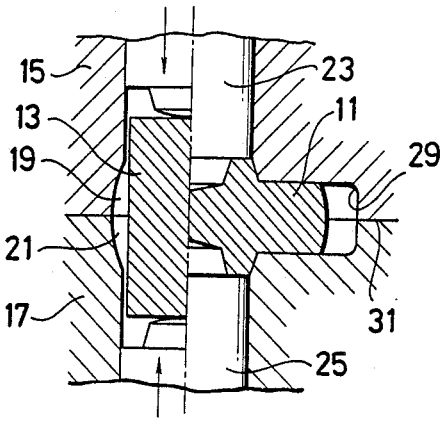
FIG. 17 is a side view showing a conventional full enclosed die forging method.
Figure 18:
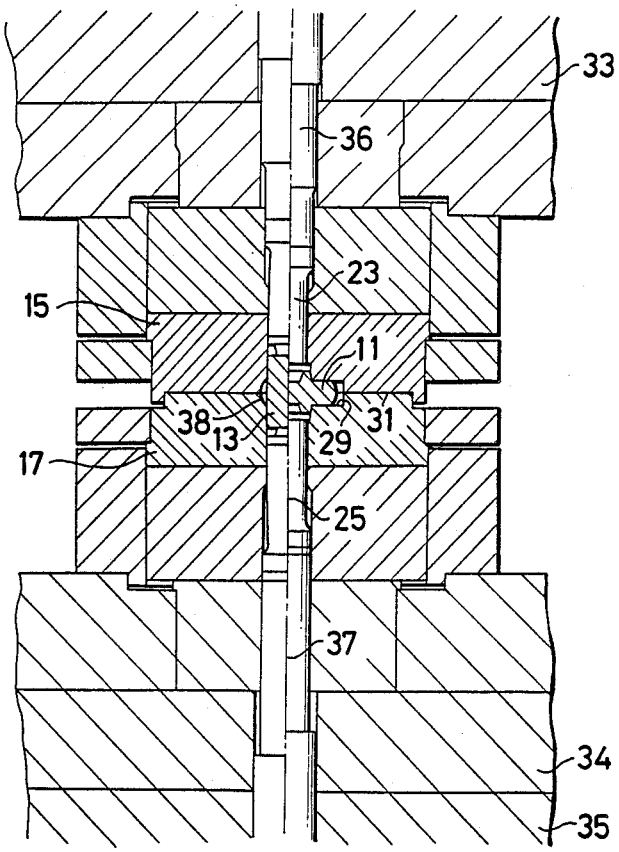
FIG.18 PRIOR ART
FIG. 18 and FIG. 19 are longitudinal cross-sectional views showing conventional full enclosed die forging apparatus, respectively.
Figure 19:
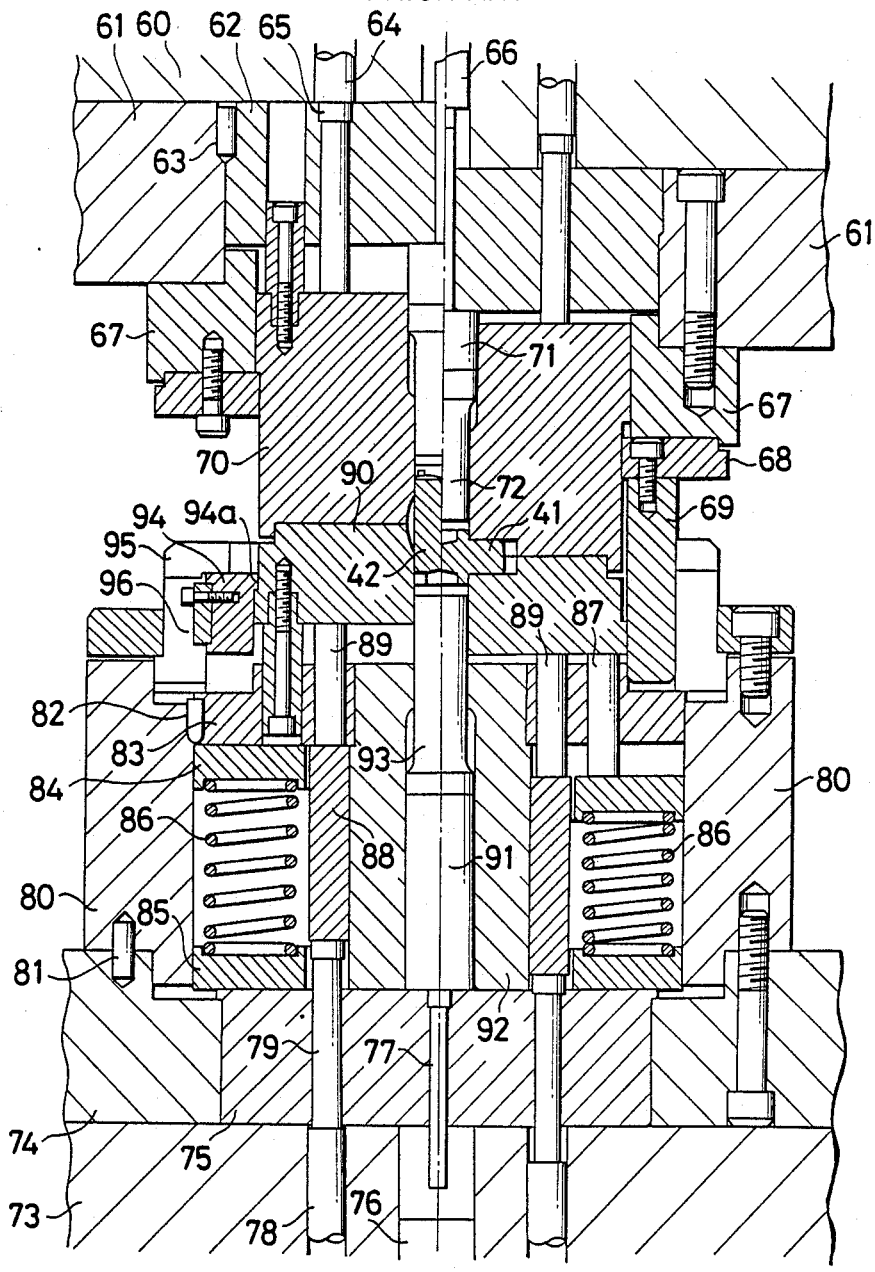
FIG.19 PRIOR ART
Figure 20:
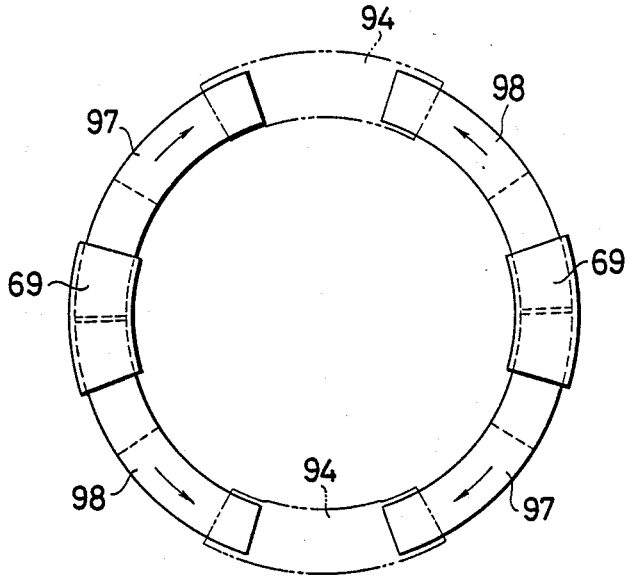
FIG.20 PRIOR ART
FIG. 20 thru FIG. 22 are explanator views showing the cam mechanism shown in FIG. 19.
Figure 21:
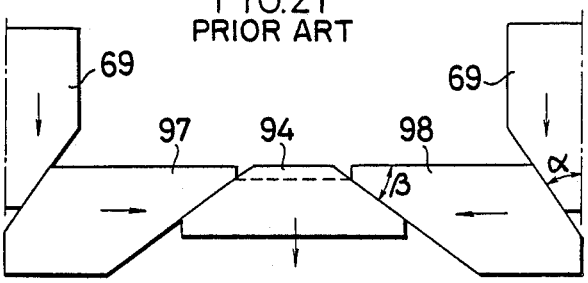
FIG.21 PRIOR ART
Figure 22:
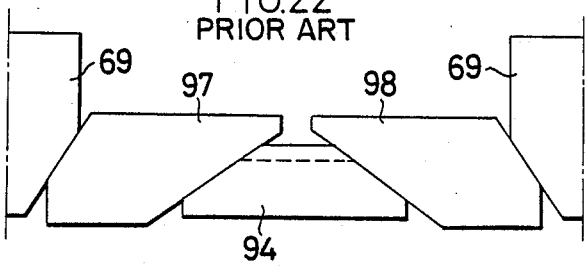
FIG.22 PRIOR ART

That is, cutout portions 278 are formed at four positions on the upper part of underside pad 277 as shown in FIG. 13. And, a cam face 279 is formed on each of these cutout portions.

A cam surface 281 of a horizontal cam 280 in a rectangular parallelopiped form is made to abut against this cam face 279. Further, a cam face 284 of a vertical cam 283 in a plate form is made to abut against the cam face 282 formed at another end of the horizontal cam 280. When the slide descends, a lower end of a pin 285 shown in FIG. 9, etc. is made to abut against the upper face of the vertical cam 283.

As shown in FIG. 9, in the full enclosed die forging apparatus thus constructed, slug 213 inserted into cavity 272 of underside die 270 is formed under fully enclosed state produced by upside die 250 and underside die 270 abutting against each other, and is taken out by the action of knockout pins 254 and 274, etc.

Here, the molding load is transferred to slide 243 through upside punch 251, upside keep plate 252 and upside die set plate 244, and at the same time, to bolster 257 through underside punch 271, punch plate 275 and underside die set plate 258, respectively.

And, in the full enclosed die forging apparatus thus constructed, the lower end face of push pin 286 contacts the upper end face of pin 285 when upside die 250 and underside die 270 come into contact with each other. When slide 243 further descends thereafter and push pin 286 descends, pin 285 descends, thus vertical cam 283 also descends. With this, horizontal cam 280 is pressed toward the cam face of the underside pad 277, underside pad 277 moves downward, and at the same time, upside die 250 and underside die 270 also move downward.

Here, when it is assumed that cam angles of the vertical cam 283 and the horizontal cam 280 are $\alpha$ and $\beta$ respectively, the descending speed ratio of the underside pad 277 to the vertical cam 283 is given as follows:

$$\tan \alpha \times \tan \beta$$

Accordingly, after the vertical cam 283 comes in contact with the horizontal cam 280, the underside die 270 descends at a speed lower than that of the upside punch 251 as the upside punch 251 descends, and the upside punch 251 and the underside punch 271 move relatively to the upside die 250 and the underside die 270.

That is, despite that the upside die 250 and the underside die 270 descend at a speed lower than the descending speed of the upside punch 251, the underside punch 271 does not move. Therefore, when slide 243 is made to descend, upside punch 251 and underside punch 271 rush into upside die 250 and underside die 270, respectively, so as to move closely, thereby to perform expected forging.

In the full enclosed die forging apparatus thus constructed, the die moving mechanism is composed of a support member consisting of the underside pad 277 which is installed between the underside die 270 and the underside cylinder chamber 262 for supporting the underside die 270 indirectly and urged upward directly by means of the underside cylinder chamber 262, the push pin 286 moved downward synchronously with the movement of the slide 243, and the cam mechanism 276 which moves the underside pad 277 downward pursuant to the movement of the push pin 286 at a speed lower than the moving speed of the slide 243. Accordingly, it is no longer required to dispose respective cams on the outer circumference of the underside die and to descend the underside die directly with these cams as in a conventional case. Therefore, the degree of freedom for the arrangement of the cam mechanism is increased, and for example, it becomes possible to construct the cam mechanism with linear cams as shown in FIG. 13, thus the cam mechanism may be simplified by a large margin as compared with a conventional case.

As described above, in a full enclosed die forging apparatus according to the present invention, the die moving mechanism is composed of a support member which is installed between the underside die and the underside cylinder mechanism for supporting the underside die directly or indirectly and is urged upward by means of the underside cylinder mechanism directly or indirectly, the push pin which is moved downward synchronously with the movement of the slide, and the cam mechanism which moves the support member downward with the movement of this push pin at a speed lower than the moving speed of the slide. Accordingly, the degree of freedom for the arrangement of the cam mechanism is increased, thus it is possible to simplify the cam mechanism by a large margin as compared with a conventional case.

Furthermore, cam sequence consisting of adjacent vertical cam and horizontal cam may be arranged in a linear form, resulting in that each cam may be machined much more easily as compared with a conventional apparatus, thereby to obtain high accuracy. Accordingly, accurate control of the descending speed of the die becomes possible, and the accuracy of the molded article is also improved and stabilized.

Also, the push pin operating the cam mechanism is provided on the mold forming member on the slide side, and ascends and descends together with the slide of the press, but the installing space for the push pin is smaller than that for a conventional vertical cam, and the installing position has a higher degree of freedom than that of a conventional apparatus. Accordingly, in case of automatic production, accessibility of the automated apparatus to the die, etc. is improved, and superior accommodation to mass production may also be expected.

In the next place, if the cam mechanism is manufactured taking the die having the largest diameter among a plurality of subject articles into consideration, it is needed to prepare only the underside guide shown in FIG. 8 in the case of a smaller die than above-mentioned die. Thus, the cam mechanism of the present apparatus is capable of coping with dies in variety of sizes.

What is claimed is:

1. A fully enclosed die forging apparatus comprising a slide having an upside die set plate, a bolster having an underside die set plate, an upside die and an underside die disposed opposedly in a vertical direction between said slide and said bolster, a support member for supporting the underside die, an upside cylinder mechanism disposed on said upside die set plate which urges said upside die downward, an underside cylinder mechanism disposed on said underside die set plate which urges said support member with said underside die upwardly, an upside punch inserted in said upside die that moves synchronously with the movement of said slide, an underside punch inserted in said underside die and supported by said bolster, an underside die moving mechanism having a support member disposed between said underside die and said underside cylinder mechanism, a cam mechanism, an intermediate member independent of said support member and said underside die for engaging said support member in response to actuation of the cam mechanism, a push pin adapted to move synchronously for actuation of the cam mechanism with the movement of said slide, said push pin extending between said slide and said bolster for actuating the cam mechanism so as to cause the support member to be driven downwardly with descending movement by the intermediate member at a speed slower than the speed of said slide for causing both of said punches to be accelerated into said dies by moving said upside die and said underside at a slower speed than the moving speed of said slide.

2. A fully enclosed die forging apparatus as defined in claim 1 wherein said cam mechanism further comprises at least one linear vertical cam and at least one linear horizontal cam in abutting relationship to said vertical cam, the interengagement of said cams controlling downward movement of said support member.

3. A fully enclosed die forging apparatus as defined in claim 2 wherein said horizontal cam has a cam surface in the form of a rectangular parallelopiped.

4. A fully enclosed die forging apparatus as defined in claim 1 wherein said push pin is positioned to a side of said slide for accessibility to said dies.

5. A fully enclosed die forging apparatus as defined in claim 2 wherein the cam mechanism includes a plurality of linear vertical cams engaging a corresponding plurality of linear horizontal cams having camming surfaces engaging a piston of said underside cylinder mechanism.

6. A fully enclosed die forging apparatus as defined in claim 5 wherein the push pin linkage means comprises a plurality of push pins, each being received in a respective push pin cylinder carried by the slide.

* * * * *

UNITED STATES PATENT AND TRADEMARK OFFICE

CERTIFICATE OF CORRECTION

PATENT NO. : 4,914,938

DATED : April 10, 1990

INVENTOR(S) : N. Ishinaga

It is certified that error appears in the above-identified patent and that said Letters Patent is hereby corrected as shown below:

Column 13, line 17, after "underside" insert --die--.

Signed and Sealed this

Second Day of July, 1991

*Attest:*

HARRY F. MANBECK, JR.

*Attesting Officer*

*Commissioner of Patents and Trademarks*